US005484136A

United States Patent [19]

Lopes et al.

[11] Patent Number: 5,484,136

[45] Date of Patent: Jan. 16, 1996

[54] CARPET INSTALLATION TOOL

[75] Inventors: Lance L. Lopes; Wayne M. Prouty, both of Gardnerville, Nev.

[73] Assignee: Pro-Lo Pin, Inc., Minden, Nev.

[21] Appl. No.: 267,509

[22] Filed: Jun. 29, 1994

[51] Int. Cl.[6] ..... B25B 25/00

[52] U.S. Cl. ..... 254/200; 294/8.6

[58] Field of Search ..... 254/200, 204, 254/205, 206, 207, 208, 209, 210, 211, 212; 294/8.6

[56] References Cited

U.S. PATENT DOCUMENTS

| | | |
|---|---|---|
| 138,450 | 4/1873 | Terry . |
| 226,917 | 4/1880 | Jay . |
| 328,506 | 10/1885 | Moffitt . |
| 385,372 | 7/1888 | Pearl . |
| 407,823 | 7/1889 | Harlan . |
| 774,596 | 11/1904 | Moore . |
| 1,027,914 | 5/1912 | Seybold . |
| 5,007,616 | 4/1991 | Scarpino . |

*Primary Examiner*—Daniel P. Stodola
*Assistant Examiner*—Emmanuel M. Marcelo
*Attorney, Agent, or Firm*—Richard C. Litman

[57] ABSTRACT

An accessory for use with a power stretcher when installing carpet. The accessory is used at the rear, or tail of the tool, and is removable. The accessory has a plurality of pins for engaging the floor while stretching. This feature renders the stretcher more stable, and reduces tendency of the pins to penetrate a floor excessively. A second important feature is provision of a surface on which a user's knee bears, to increase downward force, while leaving the user's hands free. The pins are smooth walled, so as not to snag carpet fibers, and are bent at an angle to enable advantageous position relative to the floor. The accessory is of uncomplicated construction, having a stem which telescopes into the rear shaft of the power stretcher. A pin holder bolted to the stem, is constrained against rotation relative to the stem, and has a plurality of holes for receiving pins. The pins are retained by setscrews. The accessory replaces braces formerly employed which bear against a wall for support. The structural features of the accessory improve grip at the rear of the stretcher and prolong pin life.

17 Claims, 2 Drawing Sheets

CARPET INSTALLATION TOOL

BACKGROUND OF THE INVENTION

1. Field of the Invention

The present invention relates to an accessory for a tool for installing carpets.

2. Description of the Prior Art

Carpet being tacked during installation on a floor surface must be stretched just prior to tacking, so that it conforms to the surface on which it is installed. As carpet is installed between opposing walls, extending right up to each wall, it is difficult to grasp and manipulate the carpet while forcing it to abut the wall. Tools for holding a carpet stretched tight while abutting walls or similar vertical services have been developed to cope with this situation.

One frequently employed variety of tool includes two legs hinged to one another. Both ends of the tool engage the carpet, forming an angle between the respective legs. The ends of the legs are spread apart to stretch the carpet, and the angle formed between the legs becomes progressively wider. In most prior art devices, the "head" of the device is that portion located near carpet being tacked, and the "tail" is that portion braced against the most suitable environmental surface. Traditionally, this surface has included walls or other vertical surfaces, a bracing member being set thereagainst. In some devices, a pointed structure is provided which engages the floor at the tail, and a head is provided which has a plurality of pins or similar pointed structures. The plurality of pins evenly distributes force acting on the carpet, so that wrinkling is avoided.

Carpet stretchers employing this principle are seen in U.S. Pat. Nos. 226,917, issued to James M. Jay on Apr. 27, 1880, 407,823, issued to Samuel C. Harlan on Jul. 30, 1889, and 5,007,616, issued to Kelvin M. Scarpino on Apr. 16, 1991. In these references, one leg is extended upwardly past the hinge to provide a handle, which offers leverage when manually stretching the carpet.

In the patent to Harlan, one end of the stretcher sits on the carpet, while the other end is provided with a working head bearing sharp teeth for engaging an edge of the carpet being manipulated into place.

The device of Scarpino includes a telescoping member arranged parallel to and just above the carpet. One end is pointed, so as to engage the floor surface, and the other end has a working head including teeth for engaging the carpet. The hinged handle is pivotally attached to the telescoping member in a manner which spreads or stretches the tool. The device of Jay lacks the lever arrangement of Harlan and Scarpino.

It is important to note that in the devices of Jay, Harlan, and Scarpino, a user works at a position substantially centered over the tool, grasping the handle and remaining remote from the teeth.

U.S. Pat. No. 138,450, issued to Charles Terry on Apr. 29, 1873, discloses a carpet stretcher which grasps one edge of the carpet by pinching the same, and has pointed members for bracing the stretcher on a wooden floor while stretching the carpet.

A ratcheted winch is employed in a carpet stretcher illustrated in U.S. Pat. No. 328,506, issued to Ruth Moffitt on Oct. 20, 1885. A working head bearing teeth is constrained to slide in a groove formed in the frame of the stretcher. The stretcher lies on the carpet being installed. Stretching force is applied to the carpet by winding the winch. The carpet is maintained in the stretched condition by the ratchet.

None of the above inventions and patents, taken either singly or in combination, is seen to describe the instant invention as claimed.

SUMMARY OF THE INVENTION

The present invention provides an accessory in the form of a working head usable with a conventional stretching tool, such as the tool shown in Scarpino '616. It has been the experience of the present applicant in employing this tool that the "tail", indicated as element 31, a pin, is susceptible to improvement. One area of improvement is to reduce the load borne by the single pin 31, which may become bent or broken. Also, when great force is placed on this pin, the pin traps carpet fibers as it penetrates the carpet, leaving an unsightly anomaly in the even weave of the carpet fabric, and threatening to unravel the fabric. A further improvement is to provide a convenient knee contact surface, which enables a craftsman to bear down on the tool with his knee. This causes the tool to engage a wooden subfloor immediately, and preventing the tool from slipping on the floor surface. The craftsman can then easily maintain a grip on manual portions of the tool.

To these ends, a novel tailpiece is proposed which attaches to a stretching tool in place of the single pin previously employed. The tailpiece assembles quickly, requiring only a few simple hand tools.

The major components of the tailpiece are a stem for attachment to the stretching tool, a pin holding body or pin holder attachable to the stem, and pins. The stem is beveled at the point of attachment to the pin holder to define a facet or upper surface of the accessory which is well suited for providing the knee contact surface, or knee hold, discussed above.

The pin holder has a plurality of holes for receiving pins, and threaded bores to accommodate setscrews retaining the pins therein. The pins are carefully designed to avoid structural features which would snag on the carpet fabric while penetrating the same to engage the floor surface below. A plurality of pins avoids concentration of excessive force at any one point, which in the experience of the applicants has led to objectionable penetration by a sole pin of relatively soft or penetrable floor materials. This is commonly the case wherein the floor is fabricated from plywood, chipboard, and similar composite materials.

The socket by which the stem engages the shaft of the stretching tool is provided with bores alignable with a bore formed in the shaft, and a rod insertable through all of the bores. This prevents unintended disengagement of the accessory from the stretching tool.

Unintended relative rotation of the stem and the pin holder is prevented by pegs which occupy aligned bores formed in the stem and the pin holder.

Accordingly, it is a principal object of the invention to provide a floor engaging tailpiece which is installed on the rear of a carpet stretching tool.

It is another object of the invention to provide apparatus for maintaining the tailpiece installed on the carpet stretching tool.

It is a further object of the invention to provide a plurality of pins simultaneously engaging a floor surface while stretching carpet.

Still another object of the invention is to provide a pin holder formed from stock material of parallelepiped configuration.

An additional object of the invention is to provide a knee hold for accommodating a downward force to improve force bearing on the carpet, while leaving a user's hands unencumbered.

It is again an object of the invention to assemble the tail piece and to install the same on a carpet stretching tool with hand tools and commonly available components and materials.

Yet another object of the invention is to modify a conventional carpet stretching tool to avoid employing a brace bearing on a vertical wall or similar surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
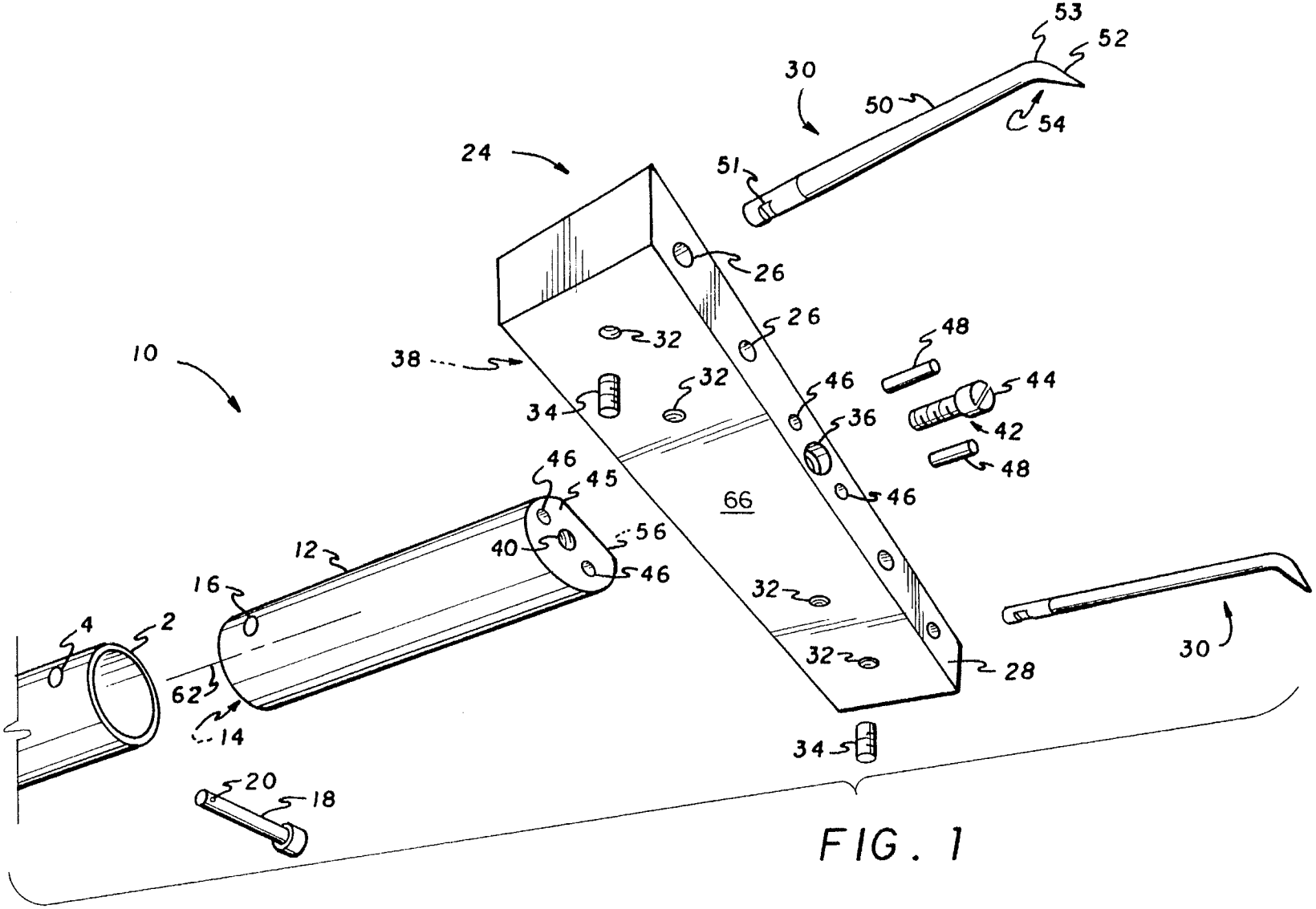
FIG. 1 is an environmental, exploded, bottom perspective view of the invention.

The principal components of the novel tailpiece 10 are shown in FIG. 1. A stem 12 includes a hollow end defining a socket 14 facing a carpet stretching tool, not shown in its entirety, and represented by its rear shaft 2. This socket 14 telescopingly interfits rear shaft 2. It will be understood that "rear shaft" is so called because it is located opposite the conventional working head (not shown).

Disengagement of socket 14 from rear shaft 2 is prevented as follows. A radial bore 16 penetrates both walls of socket 14, there being a corresponding alignable bore 4 formed in rear shaft 2. A rod 18 is inserted through bores 4 and 16, and thus holds stem 12 to rear shaft 2. Preferably, a throughbore 20 is located in rod 18 to accept a clip 22 (see FIG. 2) holding rod 18 in place.

Throughout this specification, insertion of rods or similar structures into bores or the like will signify that the rod or similar male component does not pass entirely through one or two associated bores and vacate the same, but occupies or partially occupies the bore or bores. This is intentional, providing an interference fit, as for preventing relative motion between two abutting components having aligned bores.

Stem 12 attaches to a pin holder 24 made from a right angled, parallelepiped block of material. Pin holder 24 includes holes 26 drilled through a rear surface 28 for accepting pins 30, and has threaded bores 32 which intersect holes 26, and into which setscrews 34 are inserted.

An additional bore 36 is formed in pin holder 24, extending from front surface 38 to rear surface 28. Threaded bore is axially aligned with a corresponding bore 40 formed in stem 12. Bore 40 is threaded to accept a threaded fastener, such as bolt 42. Bolt 42 includes an enlarged head 44 for clamping pin holder 24 to stem 12 when bolt 42 is tightened.

Relative rotation of pin holder 24 about the axis of bores 36 and 40 is opposed by the following arrangement. Additional, axially alignable bores 46 are drilled into pin holder 24 through rear surface 28 and into stem 12, at rear face 45, for accepting pegs 48. Interference fit of pegs 48 within bores 46 prevents such relative rotation. It should be noted that the lengths of pegs 48 and bolt 42 are not drawn to scale with respect to the width of pin holder 24.

It would be possible to form stem 12 and pin holder 24 as a single, monolithic part. This could be accomplished, for example, by molding the part from a synthetic resin. Bolt 42 and pins 48 would be eliminated in this embodiment.

Pins 30 have a straight main section 50, a pointed penetrating section 52, and a rounded, bent section 53 causing section 52 to be oriented at an angle to section 50. Each pin has a smooth lateral wall 54 unencumbered by a crease (not shown), as would arise from grinding a point into a cylindrical rod. This construction protects against snagging of carpet fibers when pins 30 penetrate the same to contact and engage a floor surface (not shown). Each pin 30 also has a relief 51, which a setscrew 34 engages when tightened.

Figure 2:
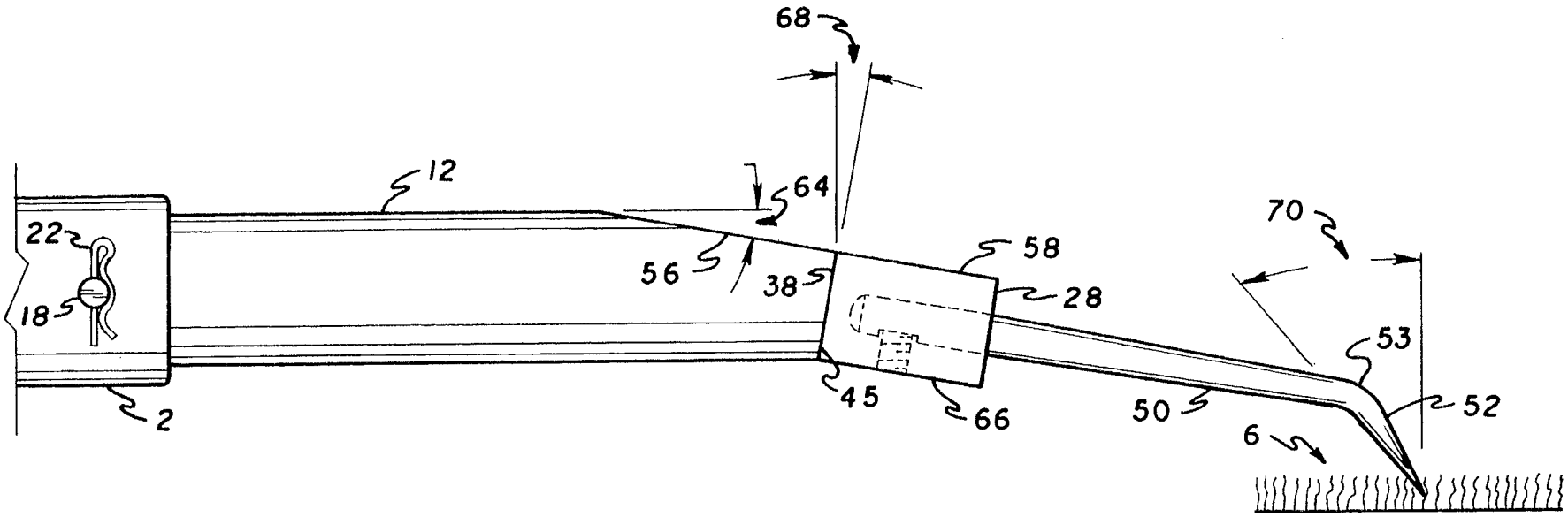
FIG. 2 is an environmental, side elevational view of the invention.

FIG. 2 also illustrates a beveled, flat upper surface 56 formed in stem 12. This surface 56 extends and is coplanar with a top surface 58 due to orientation of stem rear surface 45 with respect to longitudinal axis 62 of stem 12. This relationship is also seen in FIG. 1.

Returning to FIG. 2, beveled top surface 56 is preferably oriented at about a ten degree angle, indicated at 64, to longitudinal axis 62. Because pin holder 24 has surfaces arranged at right angles to one another, it follows that when pin holder front surface 38 abuts stem rear surface 45, pin holder top surface 58 is parallel to stem top surface 56. These surfaces 56, 58 combine to form a knee hold which is arranged at a slight angle to the floor when stem 12 is parallel to the floor, as illustrated in FIG. 2. This situation normally arises when rear shaft 2 of a carpet stretcher is fully lowered, and maximum force is being applied to a carpet 6. In this situation, the user's hands are advantageously employed to maintain a secure grip on the carpet stretcher. Thus, it is advantageous that the user apply his weight on tailpiece 10 at the knee, thereby freeing the hands from any role in this task.

With holes 26 drilled normal to rear surface 28 of pin holder 24, it follows that straight section 50 of each pin 30 is oriented at the same ten degree angle to axis 62 as are pin holder top and bottom surfaces 58,66. Also, front and rear surfaces 38, 28 (respectively) are arranged at a ten degree angle from the vertical, as indicated at 68.

Preferably, bent section 53 is so configured and dimensioned that a forty-five degree angle, shown generally at 70, is defined between the vertical and pin pointed section 52. This angle facilitates penetration of the carpet and provides a sufficiently steep incident angle between pointed section 52 and the floor to enable a secure engagement therebetween.

It is to be understood that the present invention is not limited to the sole embodiment described above, but encompasses any and all embodiments within the scope of the following claims.

We claim:

1. The combination of a tailpiece mounted on a rear shaft of a carpet stretching tool comprising:

a stem of the tailpiece having a socket at one end telescopingly interfitting the rear shaft of the carpet stretching tool, and having a first flat upper surface at an opposite end;

a pin holder connected by attachment means to said stem at said opposite end, having a second flat upper surface coplanar with said first flat upper surface of said stem to provide a knee hold oriented parallel to a floor surface, and having a plurality of holes spaced equidistantly therein for accepting pins;

a plurality of pins, each inserted in each of said plurality holes in said pin holder, each one of said pins having a straight main section, a pointed penetrating section arranged at an angle to said main section, and a rounded bent section joining said main section to said penetrating section and having a smooth lateral wall; and means for securing each said pin within each of said pin holder holes.

2. The tailpiece according to claim 1, wherein each said rounded bent pin sections dimensioned and configured such that each said pointed penetrating pin section describes an incident angle with the floor of forty-five degrees when said stem is horizontal.

3. The tailpiece according to claim 1, wherein said pin holder comprising a right-angled parallelepiped having:

a front surface, a rear surface, a top surface, and a bottom surface, said front surface abutting said stem;

said holes for receiving said pins located in said rear surface; and pin attachment means defining a plurality of first threaded bores located in at least one of said top surface and said bottom surface, there being one said first threaded bore intersecting each said hole, said means for securing each said pin to said pin holder comprising a plurality of setscrews threadably inserted into said first threaded bores, there being one setscrew for each said pin, and each said pin having a relief for engaging a said setscrew.

4. The tailpiece according to claim 3, wherein said pin holder attachment means for attaching to said stem comprising:

a second threaded bore formed in said pin holder, extending from said front surface to said rear surface of said pin holder;

a third threaded bore formed in said stem, said second and third bores axially aligned; and a threaded fastener inserted through said second bore and threadably engaging said third bore, said threaded fastener including an enlarged head clamping said pin holder to said stem.

5. The tailpiece according to claim 4, further including means for opposing axial rotation of said pin holder relative to said stem about said second and third bores comprising:

a plurality of smooth fourth bores formed in said pin holder;

a plurality of smooth fifth bores formed in said stem, each one of said fourth bores axially aligned with one of said fifth bores; and a plurality of pegs individually inserted in said smooth fourth bores and said fifth bores.

6. The tailpiece according to claim 1, further including means for opposing disengagement of said stem from a rear shaft comprising:

a first radial bore formed in said stem, alignable with a second radial bore formed in the rear shaft of the carpet stretching tool when said socket telescopingly interfits the rear shaft, and said tailpiece further including a rod inserted through said first radial bore and the second radial bore formed in the rear shaft.

7. The tailpiece according to claim 6, wherein said rod having a throughbore therein, said tailpiece further including a clip inserted in into said throughbore, for maintaining said rod inserted through said radial bore formed in said stem.

8. The tailpiece according to claim 1, wherein said stem having a longitudinal axis and a rear face oriented at a ten degree angle to said longitudinal axis, said knee hold thus being oriented at a ten degree angle to said longitudinal axis.

9. The combination of a tailpiece mounted on a rear shaft of a carpet stretching tool comprising:

a stem having a socket at one end telescopingly interfitting into the rear shaft of the stretching tool, said stem having a first flat upper surface at an opposite end;

a pin holder having attachment means for attachment to said stem at said opposite end, and having a plurality of holes spaced equidistantly therein for accepting pins, said pin holder having a second flat upper surface coplanar with said stem's upper flat surface at said opposite end, thereby providing a knee hold oriented upwardly with respect to a floor surface being carpeted when said stem is parallel to the floor surface being carpeted, said pin holder comprising a right-angled parallelepiped having a front surface, a rear surface, a top surface, and a bottom surface, said front surface abutting said stem, and said holes for receiving said pins located in said rear surface;

a plurality of pins each inserted in said pin holder, each one of said pins having a straight main section, a pointed penetrating section arranged at an angle to said main section, and a rounded bent section joining said main section to said penetrating section and having a smooth lateral wall; and means for securing each said pin within said pin holder holes comprising a plurality of first threaded bores located in at least one of said top surface and said bottom surface of said pin holder, there also being at least one said first threaded bore intersecting each said hole, and a plurality of threaded setscrews inserted into said first threaded bores, there being one setscrew for each said pin, each said pin having a relief engaging a said setscrew.

10. The tailpiece according to claim 9, wherein said pin holder attachment means for connecting to said stem comprising:

a second threaded bore extending from said front surface to said rear surface of said pin holder;

a third threaded bore formed in said stem, said second and third bores being axially aligned; and a threaded fastener inserted through said second threaded bore and said threaded third bore, said threaded fastener including an enlarged head clamping said pin holder to said stem.

11. The tailpiece according to claim 10, further including means for opposing axial rotation of said pin holder relative to said stem about said threaded second and third bores comprising:

a plurality of smooth fourth bores formed in said pin holder;

a plurality of smooth fifth bores formed in said stem, each one of said smooth fourth bores axially aligned with one of said smooth fifth bores; and a plurality of pegs individually inserted in said smooth fourth bores and said fifth bores.

12. The tailpiece according to claim 9, further including means for opposing disengagement of said stem from the rear shaft comprising:

a first radial bore formed in said stem, alignable with a second radial bore formed in the rear shaft of the carpet stretching tool when said socket telescopingly interfits the rear shaft, and said tailpiece further including a rod inserted through said aligned first radial bore and said second radial bore formed in the rear shaft.

13. The tailpiece according to claim 12, wherein said rod having means defining a throughbore therein, said tailpiece further including a clip insertable into said throughbore, for maintaining said rod inserted through said radial bore formed in said stem.

14. The tailpiece according to claim 9, wherein each said pin rounded bent sections are dimensioned and configured such that each said pointed penetrating section describes an incident angle with the floor of forty-five degrees when said stem is horizontal.

15. The tailpiece according to claim 9, wherein said stem having a longitudinal axis and a rear face oriented at a ten degree angle to said longitudinal axis, said knee hold thus being oriented at a ten degree angle to said longitudinal axis.

16. The combination of a tailpiece mounted on a rear shaft of a carpet stretching tool comprising:

a stem having a socket telescopingly interfitting into the rear shaft of the stretching tool, and having means for opposing disengagement of said stem from the rear shaft comprising a first radial bore formed in said stem at one end, alignable with a second radial bore formed in the rear shaft of the carpet stretching tool when said socket telescopingly interfits into the rear shaft, said tailpiece further including a rod insertable through said first radial bore and said second radial bore formed in the rear shaft, said stem having a bevelled flat upper surface at an opposite end;

a pin holder comprising a parallelepiped having a front surface, a rear surface having holes spaced equidistantly for accepting pins, a top surface and a bottom surface, wherein said front surface abuts said stem at said opposite end, and said pin holder having attachment means for attachment to said stem comprising a threaded first bore extending from said front surface to said rear surface of said pin holder, a second bore formed in said stem, said first and second bores axially aligned, and said second bore bearing threads, and a threaded fastener insertable through said first bore and threadably engageable with said second bore, said threaded fastener including an enlarged head clamping said pin holder to said stem, said pin holder having a second flat upper surface coplanar with said stem's upper bevelled flat surface, thereby providing a knee hold oriented upwardly with respect to a floor surface being carpeted when said stem is parallel to the floor surface being carpeted;

said stem having a longitudinal axis and a rear face oriented at a ten degree angle to said longitudinal axis, said knee hold thus being oriented at a ten degree angle to said longitudinal axis;

means for opposing relative axial rotation of said pin holder and said stem about said threaded second and third bores comprising a plurality of smooth fourth bores formed in said pin holder, a plurality of smooth fifth bores formed in said stem, each one of said smooth fourth bores axially aligned with one of said smooth fifth bores, and a plurality of pegs individually insertable in said smooth fourth and fifth bores;

a plurality of pins each insertable at one end thereof into said pin holder, each one of said pins having a straight main section, a pointed penetrating section arranged at an angle to said main section, and a rounded bent section joining said main section to said pointed penetrating section and having a smooth lateral wall, each said rounded bent section dimensioned and configured such that each said pointed penetrating section describes an incident angle with the floor of forty-five degrees when said stem is horizontal; and means for securing each said pin within said pin holder holes comprising a plurality of threaded first bores located in a surface of said pin holder selected from said top surface and said bottom surface there being one said threaded first bore intersecting each said hole, and a setscrew threadedly insertable into each said threaded first bore at an end of said pin insertable into said pin holder and having a relief engaging a said setscrew.

17. The tailpiece according to claim 16, wherein said rod having a throughbore therein, said tailpiece further including a clip insertable into said throughbore, for maintaining said rod inserted through said second radial bore formed in said stem.

* * * * *